United States Patent [19]

Niikawa

[11] Patent Number: 4,881,835

[45] Date of Patent: Nov. 21, 1989

[54] PRINTER HAVING ADJUSTABLE GAP BETWEEN PRINT HEAD AND RECORDING MEDIUM

[75] Inventor: Takeshi Niikawa, Nagoya, Japan

[73] Assignee: Brother Kogyo Kabushiki Kaisha, Nagoya, Japan

[21] Appl. No.: 184,056

[22] Filed: Apr. 20, 1988

[30] Foreign Application Priority Data

Apr. 23, 1987 [JP] Japan ..... 62-100990

[51] Int. Cl.[4] ..... B41J 11/20

[52] U.S. Cl. ..... 400/56; 400/68; 400/157.3; 400/303; 101/93.03

[58] Field of Search ..... 400/56, 57, 157.3, 303, 400/67, 68; 101/93.03

[56] References Cited

U.S. PATENT DOCUMENTS

| | | | |
|---|---|---|---|
| 4,139,692 | 1/1979 | Suzuki et al. | 101/93.03 X |
| 4,173,927 | 11/1979 | Van Kampen et al. | 400/56 X |
| 4,189,246 | 2/1980 | Kane et al. | 101/93.03 X |
| 4,248,146 | 2/1981 | Miyasahu et al. | 101/93.03 |
| 4,286,516 | 9/1981 | Nertanen | 101/93.03 |
| 4,426,165 | 1/1984 | Ino | 101/93.03 X |
| 4,652,153 | 3/1987 | Kotsuzumi et al. | 400/56 |

FOREIGN PATENT DOCUMENTS

| | | | |
|---|---|---|---|
| 117677 | 9/1981 | Japan | 400/56 |
| 150592 | 9/1982 | Japan | 400/56 |
| 128882 | 8/1983 | Japan | 400/56 |
| 84266 | 4/1986 | Japan | 400/56 |
| 237669 | 10/1986 | Japan | 400/56 |

OTHER PUBLICATIONS

Xerox Disc Journ. Frenchette, "Automatic Impression Control", vol. 1, No. 7, Jul. 1976, p. 31.

*Primary Examiner*—Edgar S. Burr
*Assistant Examiner*—James R. McDaniel
*Attorney, Agent, or Firm*—Oliff & Berridge

[57] ABSTRACT

A printer including a gap changeover device for moving a print head and a platen relative to each other and thereby adjusting a head gap between the print head and a recording medium on the platen. A switch is provided to produce a signal where the recording medium includes a local portion whose thickness is greater than that of the remaining portion. A gap control device is responsive to the signal from the switch, to change a normally established head gap to a larger value. At the same time, a speed control device is operated to lower the printing speed, according to the larger head gap.

8 Claims, 6 Drawing Sheets

PRINTER HAVING ADJUSTABLE GAP BETWEEN PRINT HEAD AND RECORDING MEDIUM

BACKGROUND OF THE INVENTION

1. Field of the Invention

The present invention relates to a printer having a platen, and a print head disposed opposite to the platen, for printing on a recording medium such as a cut sheet or envelope supported on the platen.

2. Discussion of the Prior Art

A known printer of the type indicated above is equipped with adjusting means for adjusting a clearance between the surface of the platen and the print head, so that a gap between the recording surface of the recording medium and the end face of the print head is maintained at a predetermined constant value, irrespective of the thickness of the medium.

However, the above type of known printer suffers from a problem when a printing operation is conducted on an outer surface of an envelope as shown in FIG. 6, with a predetermined constant gap D1 provided between the printing surface of the envelope and the print head. More specifically, the envelope may have an overlapping portion which consists of two or more superposed layers and which therefore has a larger thickness than the other portion. In this case, the operating end of the print head may contact or interfere with such a comparatively thick overlapping portion of the envelope when the print head is reciprocated along the platen during a printing operation. The overlapping portion of the envelope is soiled by the print head itself, or by a print ribbon if the printing is effected with the ribbon interposed between the print head and the envelope. Further, the envelope or the print ribbon may be damaged and the print head may be worn, due to the interference between the overlapping portion of the envelope and the print head.

SUMMARY OF THE INVENTION

It is therefore an object of the present invention to provide a printer which permits a printing operation on different types of recording media, which include a medium which has a thicker portion or portions than the remaining portion.

Another object of the invention is to provide a printer which is capable of accepting not only an ordinary recording medium such as a cut sheet or web having a uniform thickness over the entire recording area, but also a special recording medium such as an envelope having a comparatively thick portion, and which is capable of printing on the special recording medium, without soiling or damaging the comparatively thick portion.

The above objects may be achieved according to the principle of the present invention, which provides a printer for printing on a recording medium, comprising a platen for supporting the recording medium, a print head disposed opposite to the platen for effecting a printing operation on the recording medium supported by the platen, gap changeover means, discriminating means, gap control means, and printing speed control means. The gap changeover means is adapted to move the print head and the platen relative to each other, toward and away from each other, and thereby adjust a head gap between the recording medium and the print head. The discriminating means generates an output signal indicating that the recording medium includes a local portion whose thickness is larger than that of a remaining portion thereof. The gap control means operates to control the gap changeover means such that the head gap is normally equal to a first head gap. This gap control means is responsive to the output signal of the discriminating means, for controlling the gap changeover means such that the head gap is changed to a second head gap which is greater than the first head gap. The printing speed control means is adapted to normally select a first printing speed at which the print head effects the printing operation. The printing speed control means is responsive to the output signal of the discriminating means, for selecting a second printing speed which is lower than the first printing speed.

In the printer of the present invention constructed as described above, the head gap between the recording surface of the recording medium and the print head is changed from the first head gap to the second head gap larger than the first head gap, when the recording medium has a comparatively thick local portion or portions, like an overlapping portion as provided on an envelope. Therefore, the comparatively thick local portion of the recording medium is completely protected from otherwise possible soiling or damage due to contact with the print head. Further, the printing on the recording medium having such a comparatively thick portion can be achieved without otherwise possible deterioration of print quality or printing errors due to the increased head gap, since the printing speed is lowered from the normally selected first speed down to the lower second speed, when the head gap is increased to the second gap.

In one form of the invention, the printer further comprises guiding means, a carriage supported by the guiding means movably in a direction parallel to the platen and supporting the print head, and carriage drive means for moving the carriage. The print head comprises a plurality of print wires which are impacted against the recording medium on the platen, so as to effect the printing operation with a matrix of dots formed by impacts of the print wires. In this case, the operating stroke of the print wires is increased when the head gap is increased to the second head gap. An increase in the operating stroke of the print wires means an increased time necessary for completing an impacting motion of each wire, and therefore results in a limited printing speed, i.e., a reduced rate of movement of the carriage along the platen. Accordingly, it is desired that the printing speed control means is adapted to establish the second printing speed, by moving the carriage at a rate lower than that used for the first printing speed, and activating the print wires at a frequency lower than that for the first printing speed.

In another form of the invention, the printer further comprises second-gap changeover means for changing a value of the second head gap. For instance, the second-gap changeover means provides a plurality of values for the second head gap. In this case, the second head gap is changed in steps. Alternatively, the second-gap changeover means may be adapted such that the second head gap is continuously variable.

In a further form of the instant printer, the discriminating means includes an operator-controlled means which is operated by an operator when the recording medium has the comparatively thick local portion. For example, the recording medium is an envelope which has an overlapping portion as the comparatively thick local portion wherein a plurality of parts of the envelope are overlapped by each other. The printer may be equipped with at least one envelope feeding device for delivering envelopes for a printing operation thereon. The operator-controlled means include means for designating one of the above-indicated at least one envelope feeding device from which the envelopes are delivered.

It will be understood that while the principle of the present invention is suitably practiced for a printing operation on an envelope, the principle may also apply to printing operations on other types of recording media having comparatively thick portion or portions, for example, special blank forms having local portions having different thicknesses due to two or more overlapped sheets having different shapes.

In a still further form of the instant printer, the gap changeover means comprises means for first moving the print head into abutting contact with the recording medium on the platen, and then retracting the print head away from the recording medium by a distance corresponding to a selected one of the first and second head gaps. An example of the gap changeover means comprise a carriage for supporting the print head, an eccentric guide shaft disposed parallel to the platen and rotatably supported at opposite end portions thereof by a frame of the printer, a guide rail, rotary drive means such as a motor, and frictional power transmitting means. The eccentric guide shaft includes a carriage guiding portion which is eccentric with respect to its opposite end portions and which slidably supports the carriage. The guide rail cooperates with the eccentric guide shaft to slidably support the carriage, and permits the carriage to be moved in the direction toward and away from the platen. The frictional power transmitting means is adapted to frictionally transmit a rotary movement of the rotary drive means to the eccentric guide shaft while a resistance to rotation of the eccentric guide shaft is below a predetermined lower limit. However, the frictional power transmitting means is adapt to slip between the rotary drive means and the eccentric guide shaft while the resistance to rotation exceeds the upper limit upon abutting contact of the print head with the platen via the recording medium. In this arrangement, the print head is moved with the carriage toward the platen by the rotary drive means, via the eccentric guide shaft and the frictional power transmitting means, until the print head abuts on the platen via the recording medium.

If the rotary drive means is reversible or operated bidirectionally, a rotary movement of this rotary drive means in one direction is utilized to move the carriage toward the platen, and a rotary movement of the same drive means in the other direction is used to move the carriage away from the platen to retract the print head from the platen. The rotary movement in the other direction may be transmitted through the above-indicated frictional power transmitting means to the eccentric guide shaft. However, for accurately positioning the print head relative to the platen (more precisely, relative to the recording surface of the recording medium), it is preferred to use a one-way clutch which permits only the rotary movement of the rotary drive means in the above-indicated other direction, to the eccentric guide shaft.

An alternative arrangement of the gap changeover means comprises gap detecting means movable with the print head toward and away from the platen, for measuring the head gap. In this case, the gap control means operates in response to an output signal of the gap detecting means, to establish the first or second head gap which is selected by the gap control means, depending upon the output signal from the discriminating means. While the gap detecting means may operate in contact with the recording medium, it is desirable that the detecting means be adapted to measure the head gap, without contacting the surface of the recording medium.

BRIEF DESCRIPTION OF THE DRAWINGS

The above and optional objects, features and advantages of the present invention will become more apparent by reading the following detailed description of presently preferred embodiments of the invention, when considered in conjunction with the accompanying drawings, in which.

DETAILED DESCRIPTION OF THE PREFERRED EMBODIMENTS

Figure 1:
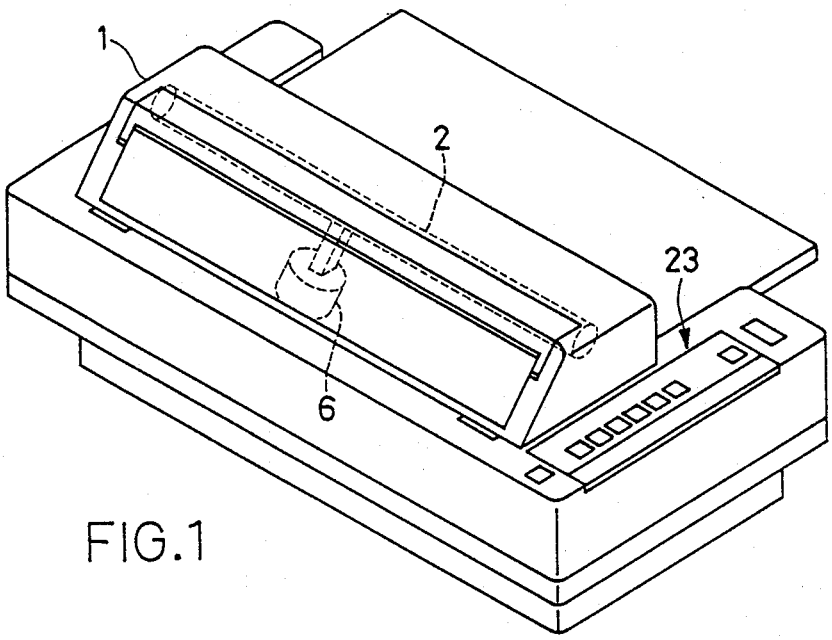
FIG. 1 is a perspective view showing an entirety of a printer embodying the present invention.
Figure 2:
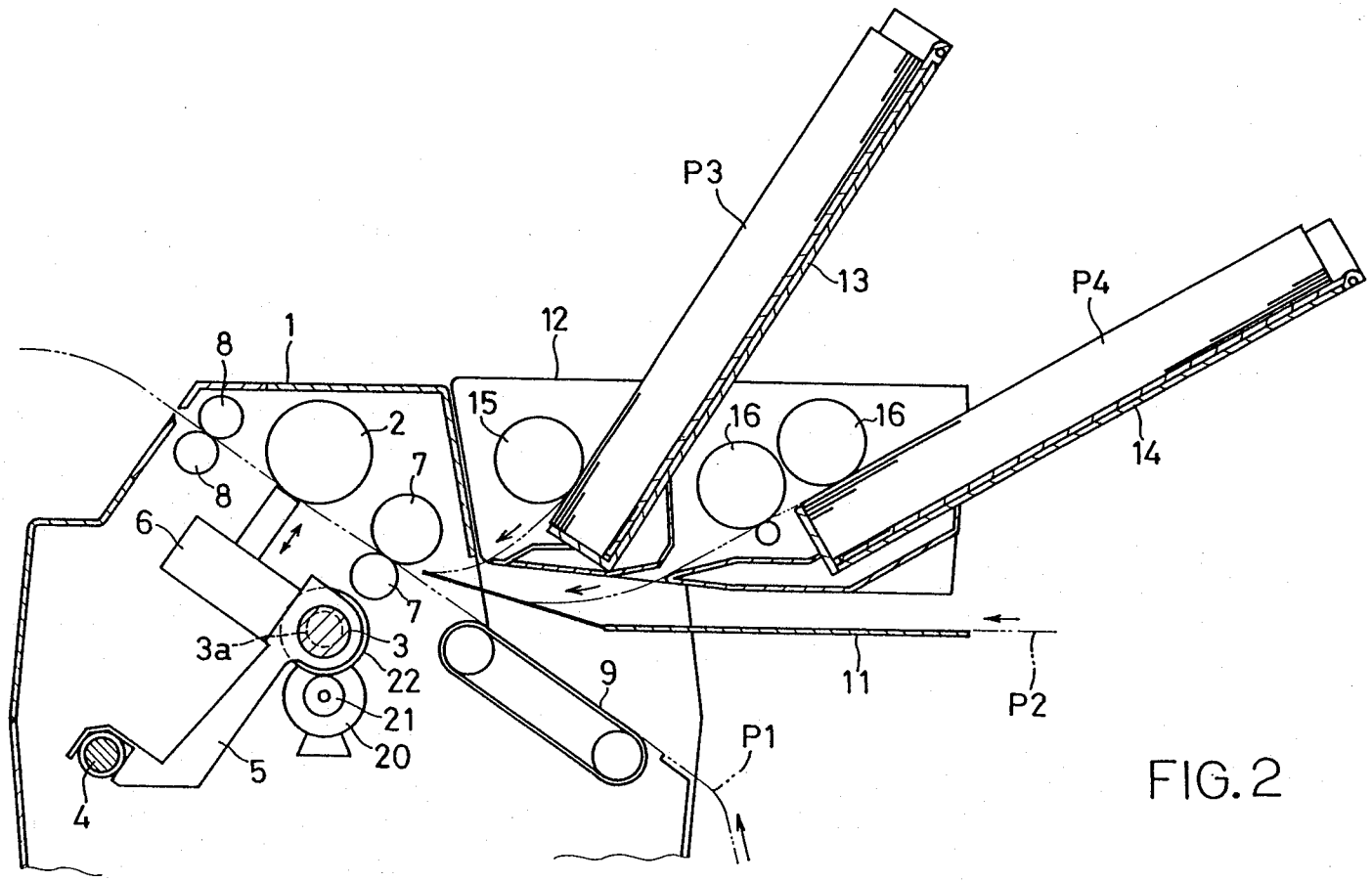
FIG. 2 is a fragmentary elevational view in cross section of the printer of FIG. 1.

Referring first to FIGS. 1 and 2, there is shown a frame 1 of the printer in which a platen 2 is rotatably supported. In front of and below the platen 2, there are disposed an eccentric guide shaft 3 and a guide rail 4, which extend parallel to the platen. A carriage 5 is supported by the guide shaft and rail 3, 4 slidably in the longitudinal direction of the platen 2. The carriage 5 carries a print head 6 mounted thereof such that the print head 6 is in opposed relation with the platen 2. The print head 6 has a plurality of print wires which are impacted against a recording medium supported on the platen 2, so as to effect a printing operation with a matrix of dots formed by impacts of the print wires. A pair of feed rolls 7 are disposed upstream of the platen 2 as viewed in a paper feeding direction, and another pair of feed rolls 8 are disposed downstream of the platen in the paper feeding direction. With the feed rolls 7, 8 rotated in the appropriate direction, a recording medium in the form of a paper web, a cut sheet or an envelope (which will be described) i fed along a paper path between a printing portion of the print head 6 and the opposite circumferential surface of the platen 2. A pair of pin tractors 9 are disposed on a paper loading side of the printer, adjacent to the upstream feed rolls 7. The pin tractors 9 are rotated to feed a paper web P1 toward a nip between the feed rolls 7. The two pairs of feed rolls 7, 8 and the pin tractors 9 are operatively connected to a paper feed motor 10 shown in FIG. 4, and are driven by this motor 10.

Above the pin tractors 9, there is disposed a manual paper inserting plate 11 such that the plate 11 is substantially horizontally supported by the printer frame 1. This plate 11 is provided to manually insert a suitable recording medium such as a cut sheet or an envelope, into the nip of the upstream feed rolls 7. The frame 1 also supports an automatic cut-sheet feeder 12, which is disposed above the manual paper inserting plate 11. The feeder 12 includes a first and and a second paper stacker 13, 14, which are adapted to store respective stacks of cut sheets P3, P4 or envelopes P5 (which will be described) of different sizes or kinds. The first and second paper stackers 13, 14 are provided with respective feed rolls 15, 16, which are operatively coupled to a stacker feed motor 17 shown in FIG. 4. The motor 17 is operated bidirectionally, and suitable means is provided to transmit a rotary movement of the motor in one direction to one of the feed rolls 15 and 16, and transmit a rotary movement of the same in the other direction to the other feed rolls 15, 16.

Figure 4:
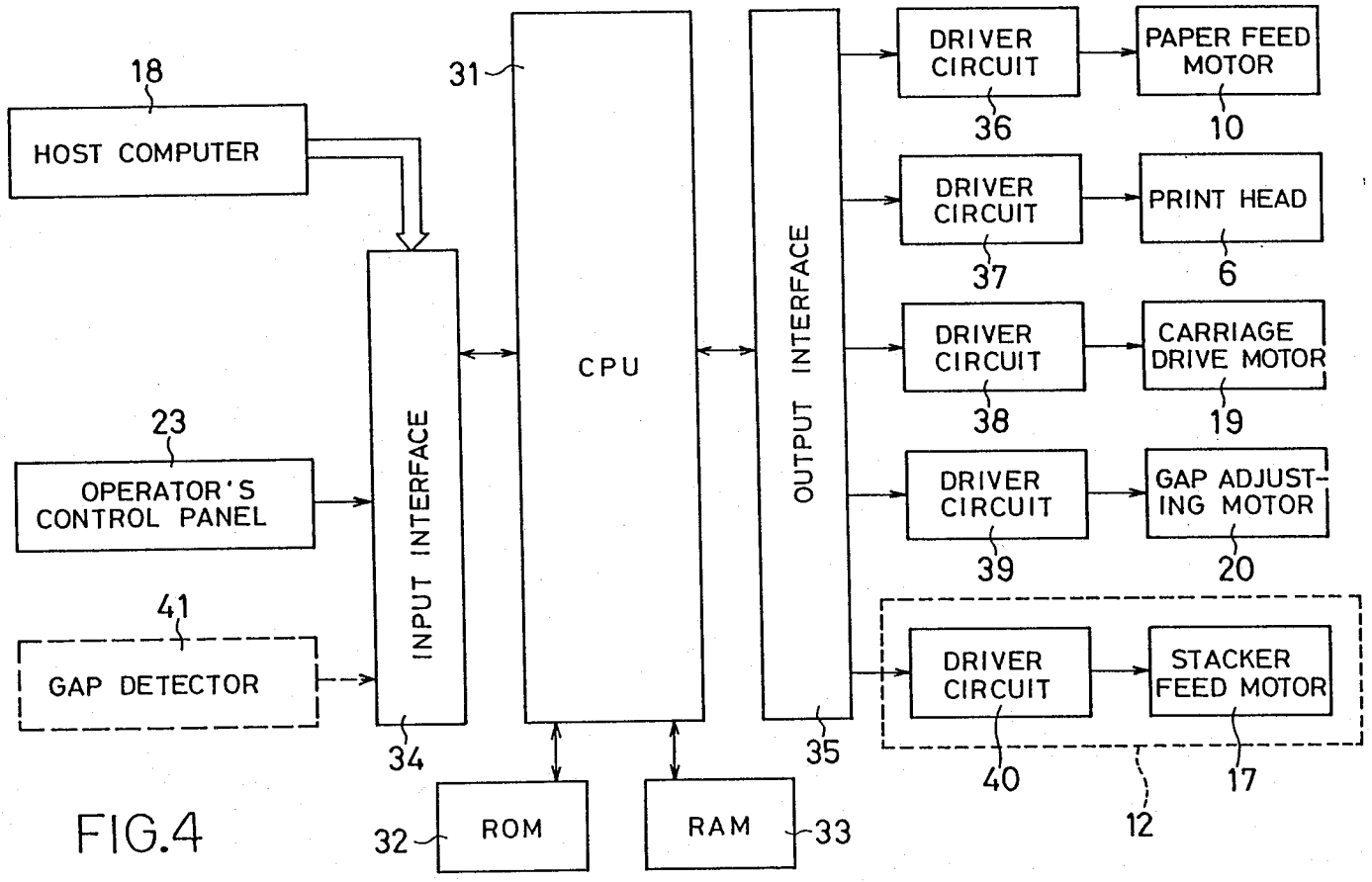
FIG. 4 is a block diagram of a control system of the printer.

The instant printer is operable in two modes, i.e., an ON LINE mode in which the printer can operate from output data received from a host computer 18 shown in FIG. 4, and an OFF LINE mode in which the printer is inoperative from the output data from the host computer 18. In the ON LINE mode, the print head 6 and a carriage drive motor 19 also shown in FIG. 4 are operated according to the data from the host computer 18, whereby a printing operation is effected on a recording medium on the platen 2 while the carriage 5 is moved in the printing direction parallel to the platen 2.

As shown in FIG. 2, the eccentric guide shaft 3 has opposite eccentric end portions 3*a* at which the guide shaft 3 is rotatably supported by respective side plates of the frame 1. One of the opposite end portions 3*a* is provided with a slip clutch (not shown) through which a gear 22 is supported on the guide shaft 3. The gear 22 meshes with a gear 21 secured to an output shaft of rotary drive means in the form of a gap adjusting motor 20 fixed to the frame 1. When the gear 21 is rotated by the motor 20 in the clockwise direction as seen in FIG. 2, the guide shaft 3 is rotated in the counterclockwise direction as seen in the same figure, via the gear 22 and the slip clutch. As a result of this rotation of the guide shaft 3, the axis of the shaft 3 is displaced in a direction that causes the carriage 5 to move toward the platen 2, and the end face of the print head 6 on the carriage 5 comes into contact with a recording surface of the recording medium. Thereafter, the gear 21 is rotated by the gap adjusting motor 20 in the counterclockwise direction as seen in FIG. 2, whereby the eccentric guide shaft 3 is rotated via the gear 22 in the clockwise direction, by an appropriate amount. As a result, the axis of the guide shaft 3 is displaced in the direction opposite to that indicated above, i.e., in a direction away from the platen 2, and the carriage 5 is moved away from the platen 2 by an appropriate distance, so that a head gap between the recording surface of the recording medium and the end face of the print head 6 is maintained at a predetermined first value D1, irrespective of the thickness of the recording medium. The slip clutch indicated above is adapted to slip when a load applied to the guide shaft 3 in the direction of displacement toward the platen 2 exceeds a certain lower limit, that is, when a resistance to rotation of the eccentric guide shaft 3 exceeds the lower limit due to abutting contact of the end face of the print head 6 with the platen 2 via the recording medium. Consequently, the recording medium, print head 6 and platen 2 are protected from damages due to the abutting contact of the print head against the platen 2 via the recording medium.

Figure 3:
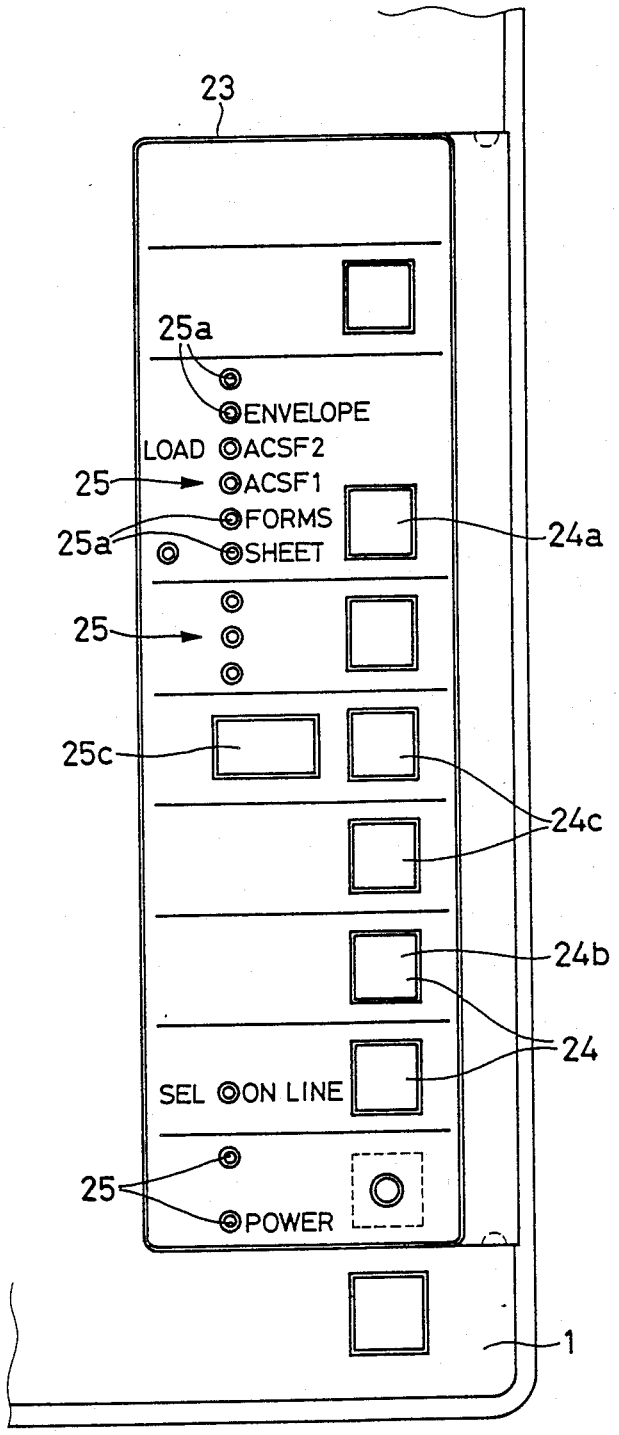
FIG. 3 is a fragmentary enlarged plan view of an operator's control panel of the printer.

As shown in FIGS. 1 and 3, an operator's control panel 23 is provided on a portion of the upper surface of the frame 1 on one of opposite lateral sides thereof. This operator's control panel 23 has a plurality of function keys 24 and a plurality of indicators 25. The function keys 24 includes discriminating means in the form of a MODE SELECTOR switch 24*a*. To the left of this MODE SELECTOR switch 24*a*, there are provided indicia indicating printing modes: SHEET, FORMS, ACSF1, ACSF2 and ENVELOPE. The indicators 25 include indicator lamps 25*a* which are disposed to the left of the respective indicia. The SHEET mode is used for printing on the cut sheet P2 manually inserted through the manual paper inserting plate 11, and the FORMS mode is used for printing on the paper web P1 loaded by the pin tractors 9. The ACSF1 mode is established when a printing is effected on the cut sheets P3 or envelopes P5 (which will be described referring to FIG. 6) automatically delivered from the first paper stacker 13 of the automatic cut-sheet feeder 12, and the ACSF2 mode is established for printing on the cut sheets P4 or envelopes P5 automatically delivered from the second paper stacker 14. Further, the ENVELOPE mode is established for printing on an envelope P5 manually inserted through the plate 11. These modes are sequentially selected one after another by repeatedly pressing the MODE SELECTOR switch 24*a*, and the corresponding indicator lamps 25*a* are activated to indicate the currently selected mode. In this connection, it is noted that each of the ACSF1 and ACSF2 modes have two sub-modes, one for printing on the cut sheet P3, P4 delivered from the appropriate stacker 13, 14, and the other for printing on the envelope P5 delivered from the same stacker 13, 14. This sub-modes of the ACSF1 and ACSF2 modes are also selected by pressing the MODE SELECTOR switch 24*a* Described more specifically, the sub-mode for printing on the cut sheet in the ACSF1 mode is selected by pressing the MODE SELECTOR switch 24*a* when the FORMS mode is selected. In this position, only the ACSF1 lamp 25*a* corresponding to the ACSF1 mode is illuminated. If the MODE SELECTOR switch 24*a* is again pressed in this condition, then the ACSF1 and ENVELOPE lamps 25*a* are illuminated. In this condition, the sub-mode for printing on the envelope P5 in the ACSF1 mode is selected. This sub-mode is referred to as "ENVELOPE-ASCF1" mode. If the MODE SELECTOR switch 24*a* is again pressed, only the ACSF2 lamp 25*a* is illuminated and the sub-mode for printing on the cut sheet in the ACSF2 mode is selected. If the MODE SELECTOR switch 24*a* is again pressed, then the ACSF2 and ENVELOPE lamps 25*a* are illuminated. In this condition, the sub-mode for printing on the envelope P5 in the ACSF2 mode is selected. This sub-mode is referred to as "ENVELOPE-ACSF2" mode. If the MODE SELECTOR switch 24*a* is again pressed, then the ENVELOPE mode is selected with the ENVELOPE lamp 25*a* illuminated.

In the present embodiment, the MODE SELECTOR switch 24*a* generates an output signal indicative of one of the ENVELOPE mode, ENVELOPE-ACSF1 mode and ENVELOPE-ACSF2 modes. Namely, the output signal from the MODE SELECTOR switch 24*a* indicates that a printing operation is effected on the envelope P5 manually inserted through the plate 11, or on the envelope P5 automatically delivered from the first or second paper stacker 13, 14. The printer is loaded with the appropriate recording medium used in the selected mode, by pressing a LOAD START key 24*b*, one of the function keys 24 on the operator's control panel 23.

Referring to FIG. 4, a control system for the instant printer will be described. As shown in FIG. 4, the control system includes a central processing unit (CPU) 31, and a read-only memory (ROM) 32 and a random-access memory (RAM) 33 which are connected to the CPU 31. The ROM 32 stores control programs for controlling various operations of the printer, and data representative of the head gaps between the recording medium and the print head 6. The RAM 34 is adapted to temporarily store various data such as data received from the host computer 18.

The host computer 18 and the operator's control panel 23 are connected to the CPU 31 via an input interface 34, for receiving various input signals from these output devices. Further, the CPU 31 is connected to the above-described paper feed motor 10, print head 6, carriage drive motor 19, gap adjusting motor 20, and stacker feed motor 17 of the automatic feeder 12, via an output interface 35 and respective driver circuits 36, 37, 38, 39 and 40, so that the print head 6 and motors 10, 19, 20 and 17 are operated under the control of the CPU 31.

An operation of the instant printer constructed as described above will be described by reference to FIGS. 5 through 7.

Figure 5:
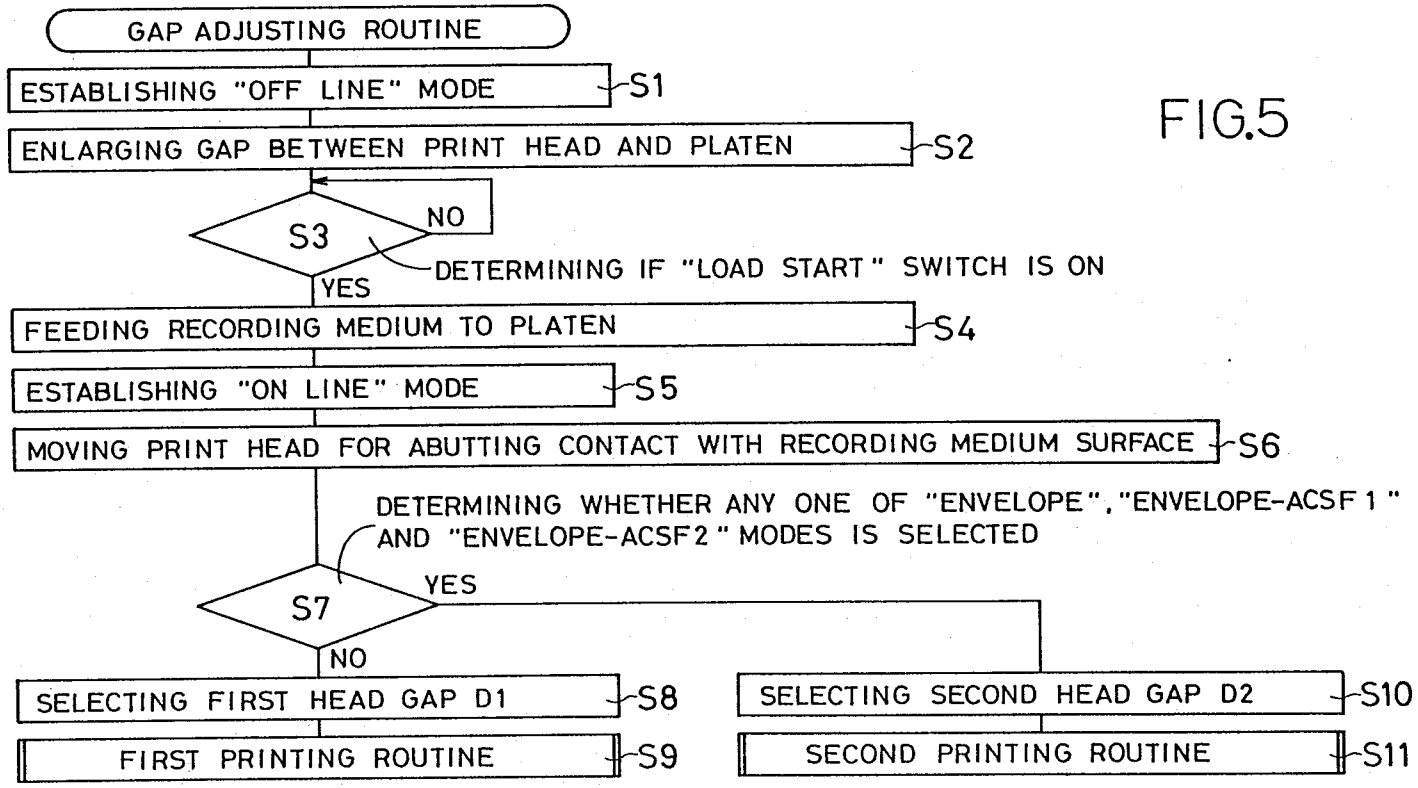
FIG. 5 is a flow chart illustrating an operation of the printer.

Each time the printer is loaded with a new recording medium, the CPU 31 executes a gap adjusting routine indicated in FIG. 5. In this gap adjusting routine, the CPU 31 first executes step S1 in which the printer is placed in the OFF LINE mode. In the next step S2, the gap adjusting motor 20 is operated via the driver circuit 39, whereby the gear 21 is rotated in the counterclockwise direction as seen in FIG. 2. As a result, the eccentric guide shaft 3 is rotated clockwise, and the axis of the shaft 3 is accordingly displaced so as to move the carriage 5 away from the platen 2, thereby enlarging the gap between the print head 6 and the platen 2.

In step S3, the CPU 31 determines whether the LOAD START switch 24*b* on the operator's control panel 23 has been turned on, or not. This determination step S3 is repeatedly executed until the LOAD START switch 24*b* is turned on. When the LOAD START switch 24*b* is turned on, an affirmative decision (YES) is obtained in step S3, and the control flow goes to step S4 in which the CPU 31 activates only the paper feed motor 10 via the driver circuit 36, by a predetermined amount. Alternatively, the CPU 31 first activates the stacker feed motor 17 of the automatic cut-sheet feeder 12 via the driver circuit 40 by a predetermined amount, and then activates the paper feed motor 10 via the driver circuit 36. Thus, a newly loaded recording medium P1 (paper web), P2, P3, P4 (cut sheet), or P5 (envelope) is fed to the platen 2. Since the gap between the print head 6 and the platen 2 has been enlarged in step S2, the leading end portion of the recording web, sheet or envelope P1–P5 can be smoothly passed between the print head 6 and the platen 2, without being caught or damaged by the end of the print head 6.

Step S4 is followed by step S5 in which the CPU 31 places the printer in the ON LINE mode. Then, the CPU 31 goes to step S6 in which the gap adjusting motor 20 is activated via the driver circuit 39, whereby the gear 21 is rotated through a predetermined angle in the clockwise direction as seen in FIG. 2. As a result of this rotation of the gear 21, the eccentric guide shaft 3 is rotated counterclockwise as seen in FIG. 2, whereby the axis of the guide shaft 3 is displaced in a direction opposite to that of the displacement in step S2, so that the carriage 5 is moved toward the platen 2 until the end face of the print head 6 comes into abutting contact with the recording surface of the recording medium on the platen 2. Although the gap adjusting motor 17 is kept operated for a short time even after the print head 6 abuts on the recording medium, a rotating motion of the motor 17 after the abutment of the print head 6 on the medium will not be imparted to the guide shaft 3, due to a slipping action of the slip clutch indicated above. Therefore, the recording medium is protected from an excessive force transmitted through the print head 6, or a resulting damage by the print head.

Figure 6:
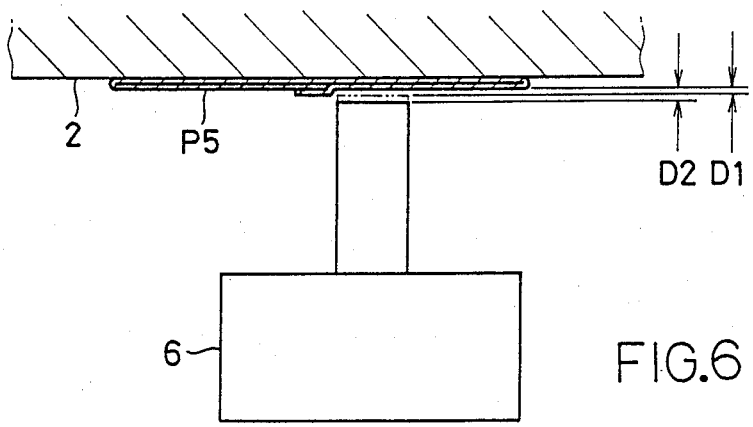
FIG. 6 is a fragmentary enlarged cross sectional view, explaining an adjustment of a head gap between the print head and the surface of the recording paper.
Figure 7A:
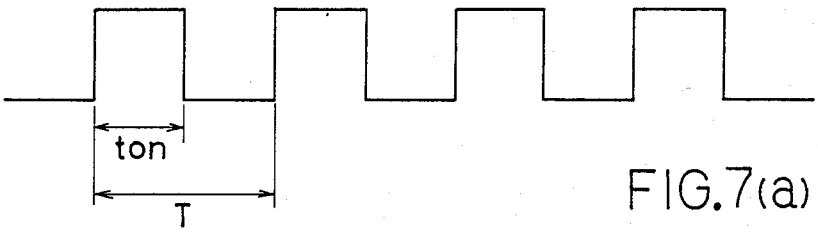
FIGS. 7(*a*) and 7(*b*) are time charts showing periods of drive signals for the print head and the carriage of the printer.
Figure 7B:
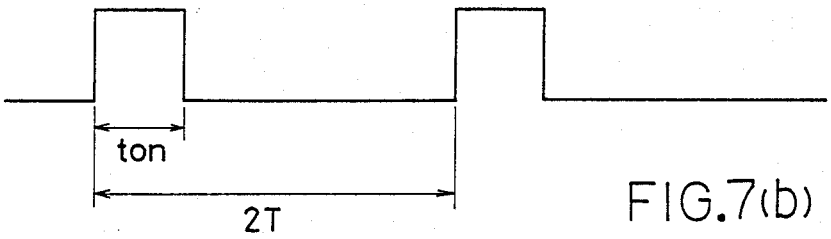

After the execution of step S6, the CPU 31 goes to step S7 to determine whether the output signal of the MODE SELECTOR switch 24*a* indicates any one of the ENVELOPE, ENVELOPE-ACSF1 or ENVELOPE-ACSF2 modes in which an printing operation is effected on the envelope P5. If the output signal of the SELECTOR switch 24*a* does not indicate any one of these three modes, this means that the printer is placed in a mode other than the ENVELOPE, ENVELOPE-ACSF1 and ENVELOPE-ACSF2 modes. In this case, a negative decision (NO) is obtained in step S7, and the CPU 31 goes to step S8 in which the CPU 31 activates the gap adjusting motor 20 via the driver circuit 39, by a first predetermined amount stored in the ROM 32, to rotate the gear 21 in the counterclockwise direction. As a result, the carriage 5 is retracted from the platen 2 by a suitable distance so that there is established a first gap distance D1 between the end face of the print head 6 and the recording surface of the recording medium (other than the envelope P5), as indicated in FIG. 6. Then, the CPU 31 goes to step S9 to execute a first printing routine, wherein the CPU 31 operates according to printing data received from the host computer 18. In this first printing routine, the print wires of the print head 6 are activated through the driver circuit 37, with drive pulses having a period T, while the carriage drive motor 19 is activated through the driver circuit 38, with exciting pulses having the period T, as indicated in FIG. 7(*a*). Thus, the first printing operation is effected at a first printing speed suitable for printing with the first head gap D1.

If the output signal generated by the MODE SELECTOR switch 24*a* is indicative of any one of the ENVELOPE, ENVELOPE-ACSF1 and ENVELOPE-ACSF2 modes, that is, if the decision in step S7 is affirmative (YES), the CPU 31 goes to step S10 wherein the gap adjusting motor 20 is activated through the driver circuit 39, by a predetermined amount stored in the ROM 32, in order to rotate the gear 21 in the counterclockwise direction through an angle greater than that in step S8. As a result, the carriage 5 is retracted away from the platen 2 so that there is provided a second head gap D2 between the end face of the print head 6 and the recording surface of the envelope P5, except for a comparatively thicker overlapping portion in which two or more parts of the envelope are overlapped by each other. As indicated in FIG. 6, the second head gap D2 is about two times as large as the first head gap D1. With the second head gap D2 provided, the end face of the print head 6 is spaced apart from the thick overlapping portion of the envelope P5, when the print head 6 is positioned opposite to the overlapping portion.

After the execution of step S10, the CPU 31 goes to step S11 to perform a second printing routine. In this second printing routine with the second head gap D2, the CPU 31 which operates from the printing data from the host computer 18 activates the print wires of the print head 6 via the driver circuit 37, with drive pulses having a period 2T as indicated in FIG. 7(*b*). This period 2T is two times as large as the period T of the drive pulses to drive the print head 6 in the first printing routine. Further, the carriage drive motor 19 is operated via the driver circuit 38, with exciting pulses having the period 2T, in the second printing routine. Thus, the second printing routine is effected at a second printing speed which is about a half of the first printing speed in the first printing routine. It is noted that a time span "ton" during which the print wires are activated for each drive pulse is the same in both of the first and second printing routines, but a time span during which the print wires are at rest is longer in the second printing routine than in the first printing routine.

When the printing mode is changed to the ENVELOPE, ENVELOPE-ACSF1 or ENVELOPE-ACSF2 mode from the other mode in the present printer, the head gap between the recording surface of the recording medium (i.e., envelope P5) and the end face of the print head 6 is increased from the normally selected first value D1, to the second value D2 which is about two times the first value D1, as indicated in solid lines in FIG. 6. Usually, this second head gap D2 is greater than the thickness of the thick overlapping portion of the envelope P5. Accordingly, the instant arrangment completely prevents the overlapping portion of the envelope P5 from being soiled by the print head 6 itself, or by a print ribbon if a printing operation is effected with the print ribbon interposed between the print head and the recording medium. Further, the second printing routine (in the ENVELOPE, ENVELOPE-ACSF1 or ENVELOPE-ACSF2 mode) can be accomplished without printing errors due to an increased operating stroke of the print wires through the second head gap D2, since the second printing routine is carried out at a reduced speed. Namely, the second printing speed is about a half of the first printing speed, to assure high-quality printing even with the increased head gap D2.

It is possible that the thickness of the overlapping portion of the envelope P5 exceeds the predetermined value D2 of the second head gap between the surface of the remaining portion of the envelope and the end of the print head 6. In this case, the end face of the print head 6 contacts or interferes with the overlapping portion of the envelope P5. To avoid this contact, the operator's panel 23 includes two data keys 24*c* through which the operator may enter a desired value for the second head gap D2. The entered data for the second head gap D2 is displayed on a seven-segment liquid crystal display 25*c* on the panel 23. Thus, the second head gap value D2 can be changed as desired.

Figure 8:
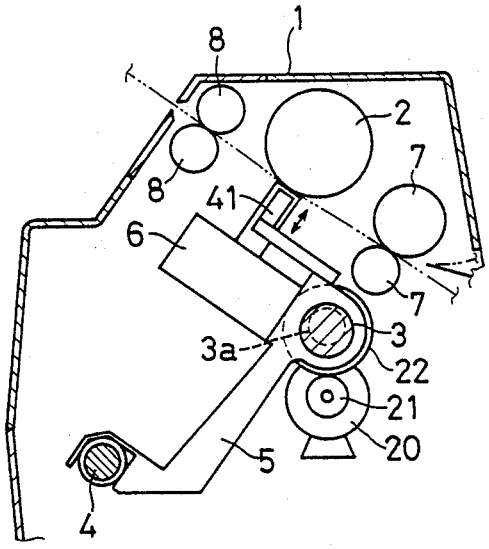
FIG. 8 is a fragmentary elevational view showing a modified embodiment of the present invention.

In the above embodiment, the gap adjusting motor 20 is operated by the predetermined amounts corresponding to the first and second gap values D1, D2, according to the stored data. This arrangement may be modified such that the gap adjusting motor 20 is operated in response to a signal from a gap detector as indicated at 41 in FIG. 8. The gap detector 41 is mounted on the carriage 5 so that the detector 41 is opposite to the recording medium and so that the detector 41 is moved with the carriage. The detector 41 is adapted to sense a distance to the surface of the recording medium, i.e., head gap between the end face of the print head 6 and the recording surface of the recording medium. The gap detector 41 is connected to the CPU 31 through the input interface 34, so that the operation of the gap adjusting motor 20 is turned off when the gap detector senses the predetermined first or second head gap D1, D2.

While the present invention has been described in the presently preferred embodiments, it is to be understood that the invention is not limited to the precise details of the illustrated embodiments, but may be embodied with various changes, modifications and improvements, which may occur to those skilled in the art, without departing from the spirit and scope of the invention. For example, the head gap D1, D2 may be established by moving only the print head 6, rather than moving the carriage 5 to move the print head 6 mounted thereon.

What is claimed is:

1. A printer for printing on a recording medium, comprising:

a platen for supporting the recording medium;

a print head disposed opposite to said platen, for effecting a printing operation on said recording medium supported by said platen;

a carriage movable in a direction parallel to said platen and supporting said print head;

gap changeover means for moving said print head and said platen relative to each other in a direction toward and away from each other, and thereby adjusting a head gap between said recording medium supported by said platen and said print head;

discriminating means for generating an output signal indicating that said recording medium includes a local portion whose thickness is larger than that of a remaining portion thereof;

gap control means for controlling said gap changeover means such that said head gap is normally equal to a first head gap, said gap control means being responsive to said output signal of said discriminating means, for controlling said changeover means such that said head gap is changed to a second head gap which is greater than said first head gap; and printing speed control means for normally selecting a first printing speed at which said print head effects said printing operation, said printing speed control means being responsive to said output signal of said discriminating means, for selecting a second printing speed which is lower than said first printing speed wherein said printing speed control means comprises means for moving said carriage at a rate lower than that used for said first printing speed, and means for activating said print head at a frequency lower than that for said first printing speed to established said second printing speed.

2. A printer according to claim 1, further comprising guiding means for moving said carriage and wherein said print head comprises a plurality of print wires which are impacted against said recording medium on said platen, so as to effect the printing operation with a matrix of dots formed by impacts of said print wires.

3. A printer according to claim 1, further comprising second-gap changeover means for changing a value of said second head gap.

4. A printer according to claim 1, wherein said discriminating means includes an operator-controlled means which is operated by an operator when said recording medium has said local portion.

5. A printer according to claim 4, wherein said recording medium is an envelope which has an overlapping portion as said local portion wherein a plurality of parts of the envelope are overlapped by each other, said printer further comprising at least one envelope feeding device for delivering envelopes for said printing operation thereon, said operator-controlled means including means for designating one of said at least one envelope feeding device from which the envelopes are delivered.

6. A printer according to claim 1, wherein said gap changeover means comprises means for first moving said print head into abutting contact with said recording medium on said platen, and then retracting said print head away from said recording medium by a distance corresponding to a selected one of said first and second head gaps.

7. A printer according to claim 6, wherein said gap changeover means comprises:

an eccentric guide shaft disposed parallel to said platen and rotatably supported at opposite end portions thereof by a frame of the printer, said eccentric guide shaft including a carriage guiding portion which is eccentric with respect to said opposite end portions and which slidably supports said carriage;

a guide rail which cooperates with said eccentric guide shaft to slidably support said carriage, said guide rail permitting said carriage to be moved in said direction toward and away from said platen;

rotary drive means; and frictional power transmitting means for frictionally transmitting a rotary movement of said rotary drive means to said eccentric guide shaft while a resistance to rotation of said eccentric guide shaft is below a predetermined lower limit, said frictional power transmitting means slipping between said rotary drive means and said eccentric guide shaft while said resistance to rotation exceeds an upper limit upon abutting contact of said print head with said platen via said recording medium.

8. A printer according to claim 1, wherein said gap changeover means comprises gap detecting means movable with said print head toward and away from said platen, for measuring said head gap, said gap control means being responsive to an output signal of said gap detecting means, to establish a selected one of said first and second head gaps.

* * * * *